US010245802B2

(12) United States Patent
Lewis

(10) Patent No.: US 10,245,802 B2
(45) Date of Patent: Apr. 2, 2019

(54) DIE COMPATIBILITY ADAPTOR FOR MACHINE PRESS COMMUNICATION

(71) Applicant: Toyota Motor Engineering & Manufacturing North America, Inc., Erlanger, KY (US)

(72) Inventor: Dale A. Lewis, Lexington, KY (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 562 days.

(21) Appl. No.: 14/810,873

(22) Filed: Jul. 28, 2015

(65) Prior Publication Data

US 2017/0028662 A1 Feb. 2, 2017

(51) Int. Cl.

| | |
|---|---|
| ***B30B 15/02*** | (2006.01) |
| ***B30B 15/00*** | (2006.01) |
| ***B21D 43/02*** | (2006.01) |
| *B21D 55/00* | (2006.01) |

(52) U.S. Cl.

CPC ..... *B30B 15/02* (2013.01); *B21D 43/025* (2013.01); *B30B 15/0094* (2013.01); *B21D 55/00* (2013.01)

(58) Field of Classification Search

CPC . B30B 15/0076; B30B 15/0094; B30B 15/02; B30B 15/026; B30B 15/14; B30B 15/146; B30B 15/148; B30B 15/166; B30B 15/26; B30B 15/281; B21D 22/02; B21D 43/021; B21D 43/025; B21D 55/00; G05B 19/41815; G05B 19/4183

See application file for complete search history.

(56) References Cited

U.S. PATENT DOCUMENTS

| | | | | |
|---|---|---|---|---|
| 4,408,521 | A | 10/1983 | Schelli et al. | |
| 4,945,742 | A | 8/1990 | Schoch | |
| 5,142,769 | A * | 9/1992 | Gold | B21D 51/383 29/621.1 |
| 5,170,358 | A * | 12/1992 | Delio | G05B 19/4163 173/2 |
| 5,564,298 | A * | 10/1996 | DeMeo | B30B 15/0094 72/19.8 |
| 6,076,652 | A | 6/2000 | Head | |
| 6,101,857 | A * | 8/2000 | Fox | G05B 19/4184 700/174 |

(Continued)

FOREIGN PATENT DOCUMENTS

| | | |
|---|---|---|
| DE | 102010052040 | 7/2011 |
| EP | 1815972 | 12/2013 |

*Primary Examiner* — Edward T Tolan

(74) *Attorney, Agent, or Firm* — Dinsmore & Shohl LLP

(57) ABSTRACT

A die compatibility adaptor including a housing and a die cable extending outward from the housing and terminating at a die cable end engageable with a manufacturing die that includes a first proximity sensor configured to output a first proximity signal and a second proximity sensor configured to output a second proximity signal. The die compatibility adaptor further includes a direct cable receptacle communicatively coupled to the die cable, a duplicate cable receptacle, and one or more isolation relays positioned between and communicatively coupled to the duplicate cable receptacle and the die cable, the one or more isolation relays having a closed position and an open position. In the closed position, the duplicate cable receptacle is communicatively coupled to the die cable.

12 Claims, 3 Drawing Sheets

(56) References Cited

U.S. PATENT DOCUMENTS

| | | | | |
|---|---|---|---|---|
| 6,427,095 | B1 | 7/2002 | Allen, Jr. et al. | |
| 6,766,278 | B2 * | 7/2004 | Liu | G06Q 10/06 702/188 |
| 6,970,762 | B1 * | 11/2005 | Elliott | G05B 19/406 700/174 |
| 7,805,973 | B2 | 10/2010 | Bosga et al. | |
| 8,069,787 | B2 | 12/2011 | Koblinger et al. | |
| 2003/0033942 | A1 * | 2/2003 | Gharst | B21D 55/00 100/341 |
| 2004/0160131 | A1 * | 8/2004 | Veil | F16P 3/00 307/116 |
| 2008/0134740 | A1 * | 6/2008 | Xu | B21D 43/025 72/17.3 |
| 2012/0272843 | A1 | 11/2012 | Graff | |
| 2014/0285930 | A1 * | 9/2014 | Powell | H02H 7/00 361/47 |

* cited by examiner

DIE COMPATIBILITY ADAPTOR FOR MACHINE PRESS COMMUNICATION

TECHNICAL FIELD

The present specification generally relates to press line systems including machine presses and manufacturing dies and, more particularly, to press line systems including die compatibility adaptors configured to facilitate communicative coupling with a machine press.

BACKGROUND

Machine presses may be positioned in a press line system and may be controlled by a press line programmable logic controller (PLC). Various manufacturing dies may be positioned on the machine presses of the press line to provide tooling for a variety of manufacturing operations. The manufacturing dies may be coupled with the machine presses such that that the press line PLC, the machines presses, and the manufacturing dies of the press line systems are communicatively coupled. However, some manufacturing dies are not communicatively compatible with some press line systems.

Accordingly, there is a desire for a die compatibility adaptor that facilitates communicative coupling of manufacturing dies within press line systems.

SUMMARY

In one embodiment, a die compatibility adaptor includes a housing and a die cable extending outward from the housing and terminating at a die cable end engageable with a manufacturing die that includes a first proximity sensor configured to output a first proximity signal and a second proximity sensor configured to output a second proximity signal. The die compatibility adaptor further includes a direct cable receptacle communicatively coupled to the die cable, a duplicate cable receptacle, and one or more isolation relays positioned between and communicatively coupled to the duplicate cable receptacle and the die cable, the one or more isolation relays having a closed position and an open position. In the closed position, the duplicate cable receptacle is communicatively coupled to the die cable.

In another embodiment, a machine press system includes a machine press having a first bolster cable and a second bolster cable, a manufacturing die coupled to the machine press, the manufacturing die having a first proximity sensor and a second proximity sensor. The machine press system further includes a die compatibility adaptor having a housing and a die cable extending outward from the housing and terminating at a die cable end engageable with the manufacturing die, a direct cable receptacle communicatively coupled to the die cable and configured to receive the first bolster cable, a duplicate cable receptacle configured to receive the second bolster cable, and one or more isolation relays positioned between and communicatively coupled to the duplicate cable receptacle and the die cable, the one or more isolation relays comprising a closed position and an open position. In the closed position the duplicate cable receptacle is communicatively coupled to the die cable.

In yet another embodiment, a method of communicatively coupling a manufacturing die and a machine press includes positioning a manufacturing die on a machine press. The machine press includes a first bolster cable and a second bolster cable and the manufacturing die includes a first proximity sensor and a second proximity sensor. The method further includes providing a die compatibility adaptor including a housing, a die cable engageable with the manufacturing die, a direct cable receptacle communicatively coupled to the die cable and configured to receive the first bolster cable, a duplicate cable receptacle configured to receive the second bolster cable and one or more isolation relays positioned between and communicatively coupled to the duplicate cable receptacle and the die cable, the one or more isolation relays comprising a closed position and an open position. In the closed position the duplicate cable receptacle is communicatively coupled to the die cable. The method further includes coupling the die cable to the manufacturing die, coupling the first bolster cable to the direct cable receptacle, and coupling the second bolster cable to the duplicate cable receptacle.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to press line systems including a die compatibility adaptor for communicatively coupling a manufacturing die within a machine press. The manufacturing die includes a first proximity sensor configured to output a first proximity signal and a second proximity sensor configured to output a second proximity signal. The die compatibility adaptor includes a housing and a die cable that can be coupled with the manufacturing die. The die compatibility adaptor further includes a direct cable receptacle configured to receive a first bolster cable of the machine press and a duplicate cable receptacle configured to receive a second bolster cable of the machine press. Further, one or more isolation relays are positioned between and communicatively coupled to the duplicate cable receptacle and the die cable and include a closed position and an open position. In operation, when the second bolster cable is engaged with the duplicate cable receptacle, the one or more isolation relays are actuated into the closed position, communicatively coupling the duplicate cable receptacle and the die cable. Further, the die compatibility adaptor may be configured to split both the first and second proximity signals output by the first and second proximity sensors such that a first portion of both the first and second proximity signals are receivable by the first bolster cable and a second portion of both the first and second proximity signals are receivable by the second bolster cable.

Figure 1:
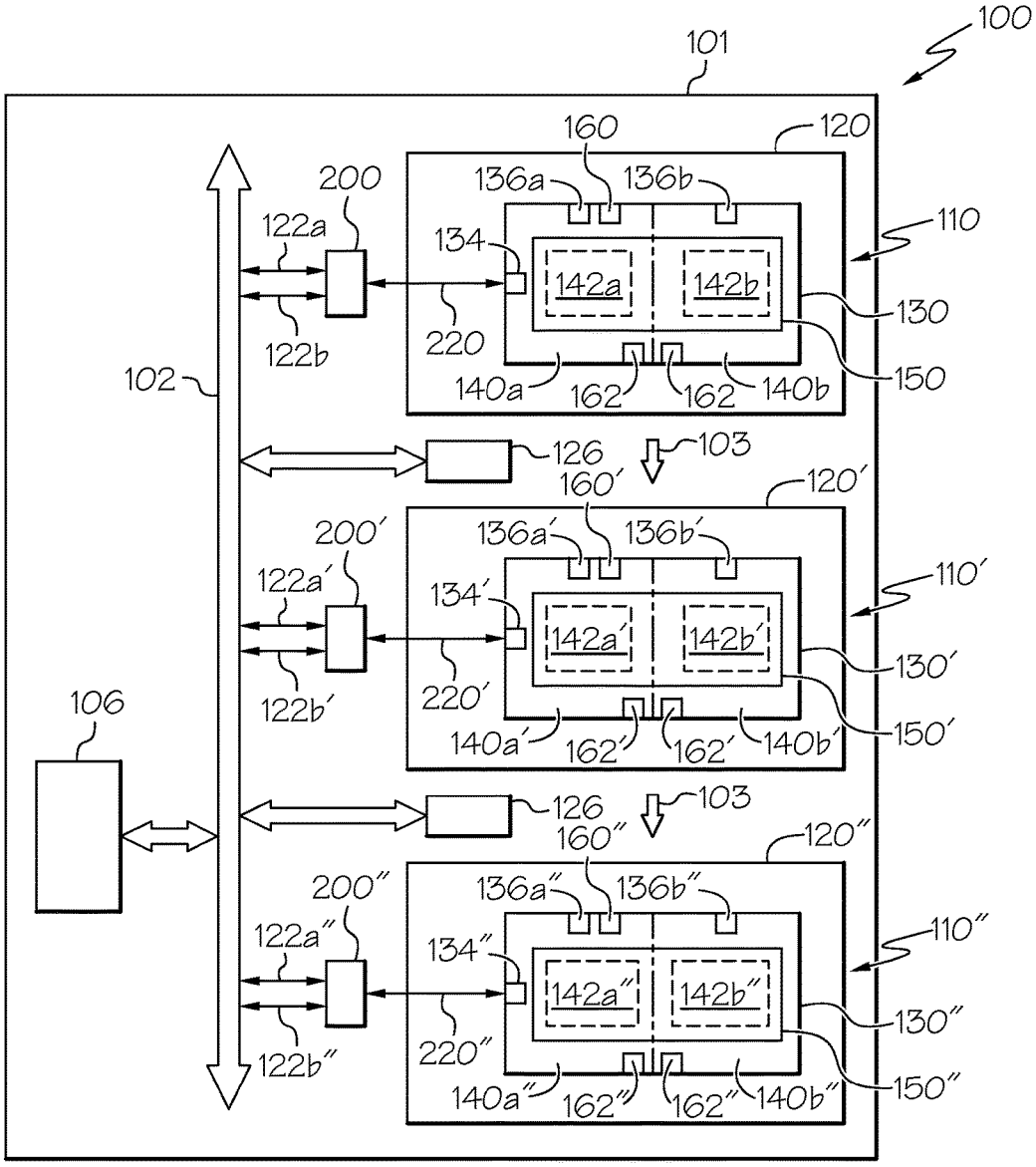
FIG. 1 schematically depicts a press line system including one or more machine presses each having a manufacturing die positioned thereon according to one or more embodiments shown or described herein.

Referring now to FIG. 1, a press line system 100 is depicted. The press line system 100 includes a press line 101 comprising one or more machine presses 110, for example a first machine press 110, a second machine press 110', a third machine press 110", and a press line programmable logic controller (press line PLC) 106 communicatively coupled to each machine press 110, 110', 110" using a communication pathway 102. As used herein, the term "communicatively coupled" means that coupled components are capable of exchanging data signals with one another such as, for example, electrical signals via conductive medium, electromagnetic signals via air, optical signals via optical waveguides, and the like. As depicted in FIG. 1, a first manufacturing die 130, a second manufacturing die 130', and a third manufacturing die 130" may be positioned on and coupled to each of the machine presses 110, 110', 110", respectively. As used herein, the term "manufacturing die" refers to the press tooling used in cutting and/or forming a part. Each manufacturing die 130, 130', 130" provides tooling such that each machine press 110, 110', 110" may perform a manufacturing operation, for example, a pressing operation, a stamping operation, a cutting operation, or the like. It should be understood that any number of machine presses 110 and manufacturing dies 130 are contemplated. Further, it should be understood that any discussion herein of an individual machine press 110 and an individual manufacturing die 130 may apply to any of the one or more machine presses 110, 110', 110" and the one or more manufacturing dies 130, 130', 130".

In operation, steps of the manufacturing operations can be uploaded or manually entered into the press line PLC 106 and communicated to the each machine press 110 along the communication pathways 102. The press line PLC 106 may comprise one or more processors capable of executing machine readable instructions such as a controller, an integrated circuit, a microchip, a computer, or any other computing device. Further, the communication pathway 102 may provide signal interconnectivity between various components of the press line system 100. Accordingly, the communication pathway 102 may be formed from any medium that is capable of transmitting a signal such as, for example, conductive wires, conductive traces, optical waveguides, or the like. In some embodiments, the communication pathway 102 may facilitate the transmission of wireless signals, such as WiFi, Bluetooth, and the like.

As schematically depicted in FIG. 1, each machine press 110 comprises a bolster 120 and a press ram 150. The bolster 120 comprises a stationary base that is used to support the manufacturing die 130 and the press tooling thereon. In some embodiments, the manufacturing die 130 may be removably coupled to the bolster 120, for example, clamped or mounted using fasteners, magnets, or the like. The machine press 110 may further comprise a first bolster cable 122*a* and a second bolster cable 122*b* extending from the bolster 120. The first and second bolster cables 122*a*, 122*b* may be communicatively coupled to the press line PLC 106. While the first and second bolster cables 122*a*, 122*b* may extend from the bolster 120, they may extend from other locations of the machine press 110 or may be directly coupled to the communications pathway 102. The first and second bolster cables 122*a*, 122*b* are configured to provide communication to and from the machine press 110. Further, the machine press 110 and the manufacturing die 130 may be communicatively coupled to the press line PLC 106 to facilitate communicative coupling between the press line PLC 106 and the manufacturing die 130 of the machine press 110. The press ram 150 may comprise a mechanically driven press, a hydraulically driven press, or the like, and the manufacturing die 130 may also be removably coupled to the press ram 150.

In some embodiments, the manufacturing die 130 comprises an upper die portion and a lower die portion each comprising one or more of a cutting surface, a stamping surface, a pressing surface, or the like. In some embodiments, the lower die portion may be coupled to the bolster 120, which provides a stationary base for the manufacturing die 130, and the upper die portion may be coupled to the press ram 150, which moves the upper die portion. In alternative embodiments, the lower die portion may be coupled to the press ram 150 and the upper die portion may be coupled to the bolster 120. The manufacturing die 130 further comprises one or more workspaces 140 (e.g., a first and second workspace 140*a*, 140*b*) positioned between the upper die portion and the lower die portion and configured to receive first and second workpieces 142*a*, 142*b*. The workpieces 142*a*, 142*b* may comprise a metal blank, for example, a tailored blank or a sheet blank.

In operation, the press ram 150 may move the upper die portion of the manufacturing die 130 toward the lower die portion such that the manufacturing die 130 may cut, stamp, or press the first and second workpieces 142*a*, 142*b* positioned within the first and second workspaces 140*a*, 140*b*, respectively. Further, the manufacturing die 130 may comprise a die communications module 134 that provides a connection module to facilitate communicative coupling between the press line PLC 106 to one or more electrical components of the machine press 110 and the manufacturing die 130, for example, a first proximity sensor 136*a*, a second proximity sensor 136*b*, and one or more gas sensors 160, each described in more detail below. In some embodiments, the die communications module 134 may include a PLC for controlling the one or more components of the machine press 110, for example, based on communication from the press line PLC 106.

As schematically depicted in FIG. 1, the press line 101 may further comprise one or more transport robots 126 positioned between each machine presses 110, for example, between the first and second machine presses 110, 110' and between the second and third machine presses 110', 110". The transport robots 126 may be configured to transport workpieces 142*a*, 142*b* between the machine presses 110 110', 110", for example, in a manufacturing direction 103. Further, the one or more transport robots 126 may be communicatively coupled to the press line PLC 106 along the communication pathway 102, such that the transport robots 126 may operate in coordination with the machine presses 110 and the manufacturing dies 130.

Referring still to FIG. 1, the manufacturing die 130 may comprise one or more gas sensors 160 communicatively coupled to one or more gas springs 162 positioned within one or both of the first and second workspaces 140*a*, 140*b* of the manufacturing die 130. The one or more gas springs 162 may comprise nitrogen gas springs, or the like, that provide support and stabilization for the first and second workpieces 142*a*, 142*b* positioned within the first and second workspaces 140*a*, 140*b*. For example, the gas springs 162 may physically support the first and second workpieces 142*a*, 142*b* between the lower die portion and the upper die portion of the manufacturing die 130 to prevent inadvertent contact between the first and second workpieces 142*a*, 142*b* and the manufacturing die 130. In operation, the gas sensor

160 may measure whether the gas springs 162 are operating properly, for example, whether the gas springs 162 are providing a predetermined support force or support force distribution, such as an evenly distributed support force. The gas sensor 160 can output an interlock signal if the gas springs 162 are not operating properly, for example, if the gas springs 162 are not providing the predetermined support force or support force distribution. Further, the gas sensor 160 may be communicatively coupled to the die communications module 134.

Referring still to FIG. 1, the manufacturing die 130 may further include one or more proximity sensors 136 configured to detect the presence of an individual workpiece 142 within an individual workspace 140. The proximity sensors 136 may be any device capable of outputting a proximity signal indicative of a presence and/or proximity of the workpiece 142 positioned within the workspace 140 of the manufacturing die 130. In some embodiments, the proximity sensors 136 may include a laser scanner, a capacitive displacement sensor, a Doppler effect sensor, an eddy-current sensor, an ultrasonic sensor, a magnetic sensor, an optical sensor, a radar sensor, a sonar sensor, or the like. As depicted in FIG. 1, the manufacturing die 130 may comprise a first proximity sensor 136*a* configured to output a first proximity signal when the first workpiece 142*a* is positioned within the first workspace 140*a*. Further, the manufacturing die 130 may comprise a second proximity sensor 136*b* configured to output a second proximity signal to when the second workpiece 142*b* is positioned within the second workspace 140*b*. In some embodiments, two or more proximity sensors 136 may be positioned in both the first workspace 140*a* and the second workspace 140*b*. Further, each proximity sensor 136, for example, the first and second proximity sensors 136*a*, 136*b*, is communicatively coupled to the die communications module 134 of the manufacturing die 130 for communication with the press line PLC 106.

In some embodiments, the press line PLC 106, for example, through the die communications module 134, may be configured to receive a pair of first proximity signals output by the first proximity sensor 136*a* and receive a pair of second proximity signals output by the second proximity sensor 136*b*. In particular, the first bolster cable 122*a* may be configured to receive a portion of both the first and second proximity signals output by the first and second proximity sensors 136*a*, 136*b*, respectively, and the second bolster cable 122*b* may be configured to receive another portion of both the first and second proximity signals output by the first and second proximity sensors 136*a*, 136*b*, respectively. For example, the press line PLC 106 may be a four proximity channel press line PLC configured to receive four channels of proximity signals (e.g., a first pair of first and second proximity signals and a second pair of first and second proximity signals) along the communications pathway 102. However, in some embodiments, the manufacturing die 130 may comprise a two proximity channel manufacturing die configured to provide an individual first proximity signal output by the first proximity sensor 136*a* and an individual second proximity signal output by the second proximity sensor 136*b*, as described above.

In some embodiments, the manufacturing die 130 of the machine press 110 (e.g., a two proximity channel manufacturing die) may not be communicatively compatible with the press line PLC 106 (e.g., a four proximity channel press line PLC). To facilitate communicative compatibility, the press line system 100 may further comprise one or more die compatibility adaptors 200 that may be communicatively coupled to the machine press 110 and the manufacturing die 130 to communicatively couple each manufacturing die 130 with the press line PLC 106. As described in more detail below, the die compatibility adaptor 200 (FIGS. 2 and 3) may be configured to split both the first and second proximity signals output by the first and second proximity sensors 136*a*, 136*b*, respectively, such that a first portion of both the first and second proximity signals are receivable by the first bolster cable 122*a* and a second portion of both the first and second proximity signals are receivable by the second bolster cable 122*b*.

Figure 2:
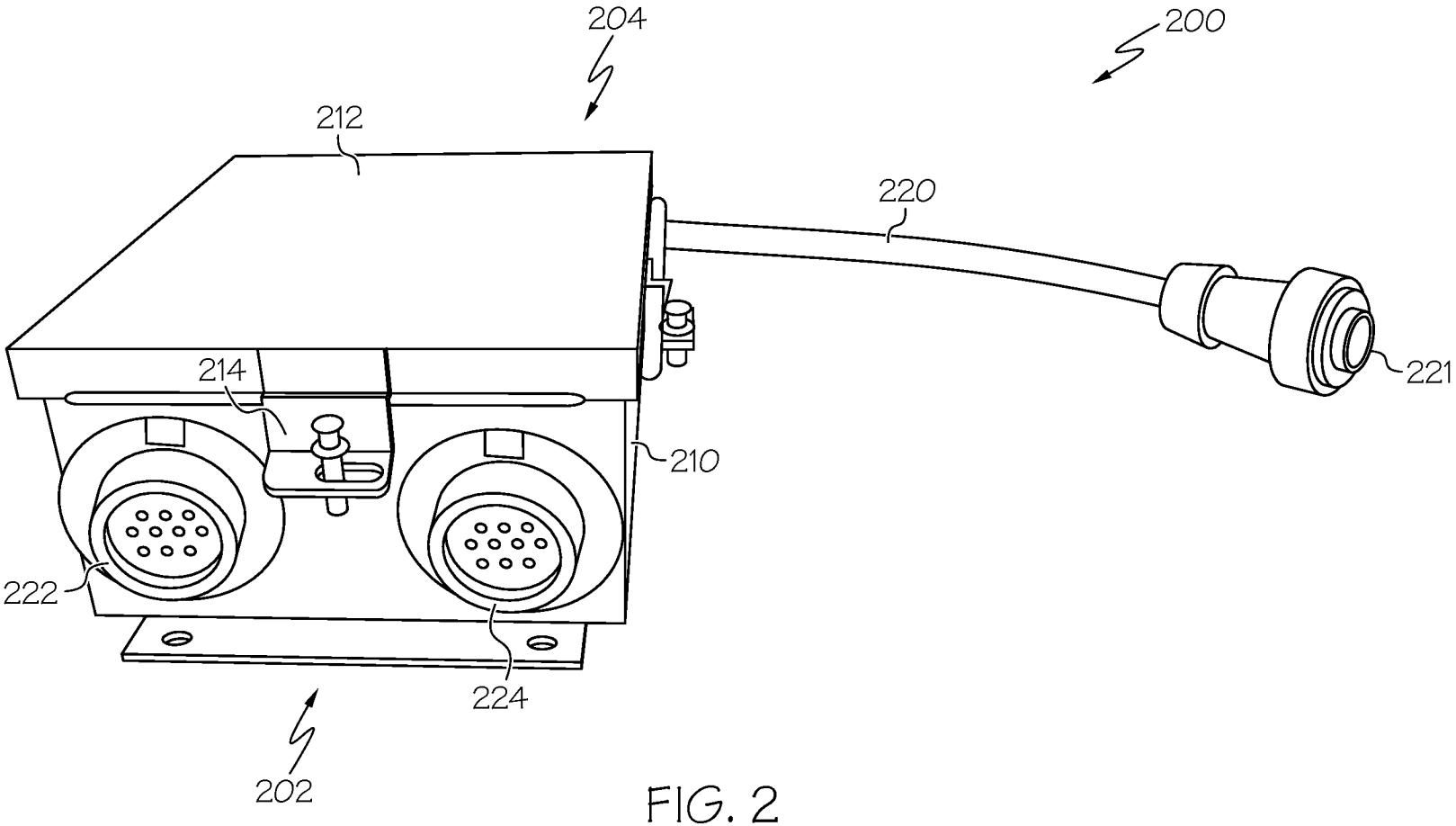
FIG. 2 depicts an isometric view of a die compatibility adaptor according to one or more embodiments shown or described herein.

Referring now to FIG. 2, the die compatibility adaptor 200 is depicted in more detail. The die compatibility adaptor 200 may comprise a housing 210 having a die connector side 202 and a bolster connector side 204. The housing 210 may comprise a cover 212, for example, a hinged cover, or the like, and may comprise one or more latches 214 for latching the cover 212 in a closed position. A die cable 220 may extend outward from the housing 210, for example, outward from the die connector side 202 of the housing 210 and may terminate at a die cable end 221 configured to removably engage the die communications module 134, to communicatively couple the die compatibility adaptor 200 and the manufacturing die 130. In some embodiments, the die cable 220 comprises a NANABOSHI cable, however, it should be understood that any cable is contemplated. In operation, when the die cable 220 is engaged with the manufacturing die 130, the die compatibility adaptor 200 may be communicatively coupled with the first proximity sensor 136*a*, the second proximity sensor 136*b*, and the gas sensor 160, and other components of the machine press 110, such as the press ram 150.

Referring still to FIG. 2, the die compatibility adaptor 200 further comprises a direct cable receptacle 222 and a duplicate cable receptacle 224 positioned, for example, at the bolster connector side 204 of the housing 210. The direct cable receptacle 222 and the duplicate cable receptacle 224 may comprise any electrical plug receptacle configured to receive an electrical plug, for example, the first bolster cable 122*a* and the second bolster cable 122*b*. The direct cable receptacle 222 and the duplicate cable receptacle 224 may both be communicatively coupled to the die cable 220 such that signals received by the die cable 220 from the press line PLC 106 are receivable by electrical plugs coupled to the direct cable receptacle 222 and the duplicate cable receptacle 224. In operation, the direct cable receptacle 222 and the duplicate cable receptacle 224 are configured to receive the first bolster cable 122*a* and the second bolster cable 122*b*, respectfully, to communicatively couple the die compatibility adaptor 200 and the press line PLC 106.

Figure 3:
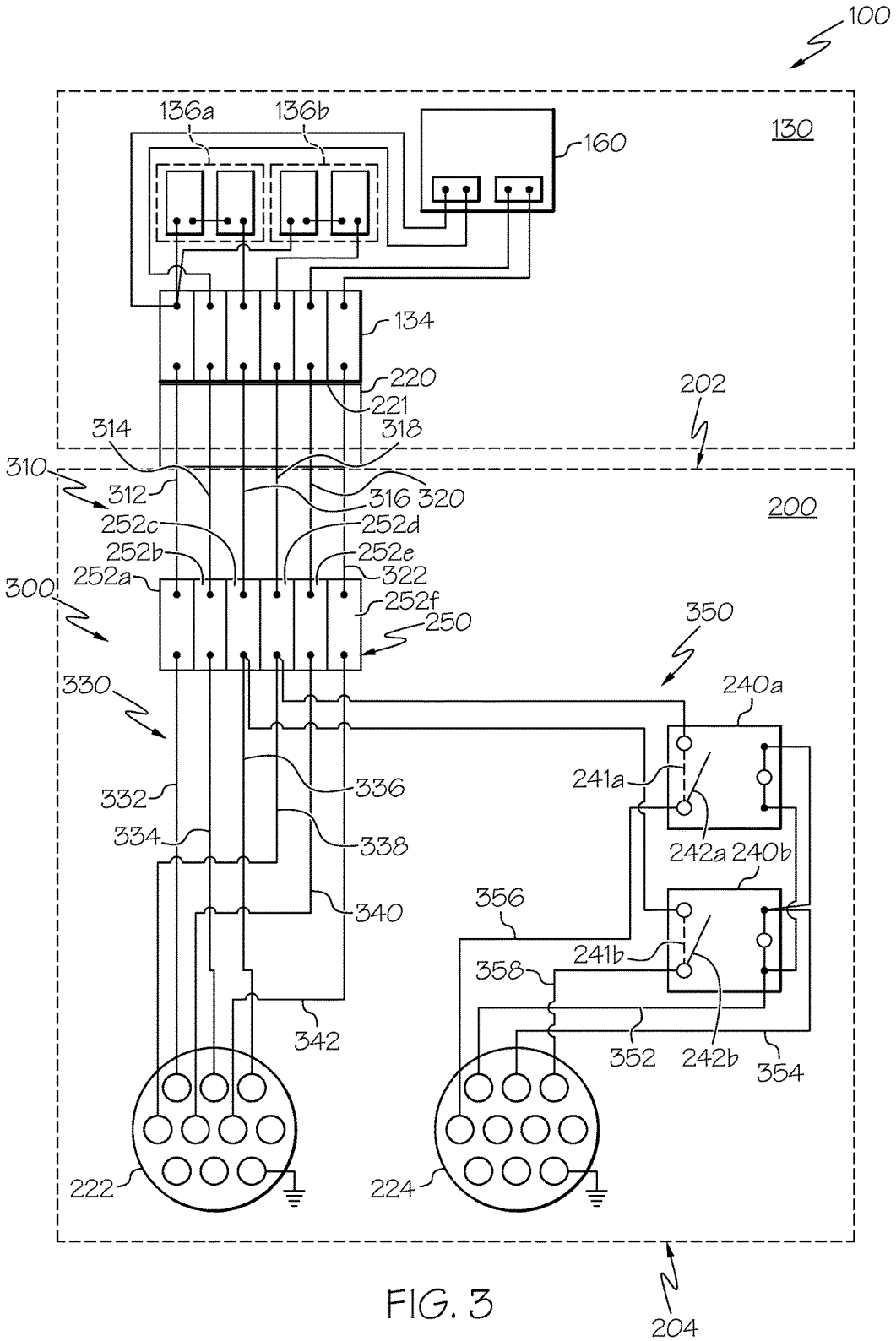
FIG. 3 schematically depicts the die compatibility adaptor of FIG. 2 communicatively coupled to a manufacturing die according to one or more embodiments shown or described herein.

Referring to FIG. 3, the die compatibility adaptor 200 further comprises one or more isolation relays 240, for example, a first isolation relay 240*a* and a second isolation relay 240*b* that each comprise a switch, such as a solid state relay, or the like. The first and second isolation relays 240*a*, 240*b* may be positioned within the housing 210 of the die compatibility adaptor 200. The isolation relays 240*a*, 240*b* may each be communicatively coupled to the die cable 220 and the duplicate cable receptacle 224 and are each actuatable between a closed position 241*a*, 241*b* and an open position 242*a*, 242*b*. In the closed position 241*a*, 241*b*, the die cable 220 is communicatively coupled to the duplicate cable receptacle 224 and in the open position 242*a*, 242*b*, the die cable 220 is not communicatively coupled to the duplicate cable receptacle 224.

In some embodiments, the first and second isolation relays 240*a*, 240*b* are actuated into the closed position 241*a*, 241*b* when the second bolster cable 122*b* is engaged with the duplicate cable receptacle 224. For example, the second bolster cable 122*b* may provide power to the first and second isolation relays 240*a*, 240*b* when engaged with the duplicate cable receptacle 224, actuating the first and second isolation relays 240*a*, 240*b* into the closed position 241*a*, 241*b*. Further, the first and second isolation relays 240*a*, 240*b* are actuated into the open position 242*a*, 242*b* when the second bolster cable 122*b* is not engaged with the duplicate cable receptacle 224. For example, when the second bolster cable 122*b* is removed from the duplicate cable receptacle 224, power is removed from the first and second isolation relays 240*a*, 240*b* such that they return to the open position 242*a*, 242*b*. In alternative embodiments, one or more isolation relays 240 may also be communicatively coupled to the direct cable receptacle 222 such that the one or more isolation relays 240 may interrupt communicative coupling between the direct cable receptacle 222 and the die cable 220.

The die compatibility adaptor 200 further comprises a plurality of signal pathways 300, such as conductive wires, conductive traces, or the like, that provide a pathway for electrical signals to traverse the die compatibility adaptor 200, for example, between the die cable 220 and one or both of the direct and duplicate cable receptacles 222, 224. In operation, the plurality of signal pathways 300 may carry an electrical signal between the manufacturing die 130, for example, the die communications module 134 of the manufacturing die 130 and one or both of the first bolster cable 122*a* and the second bolster cable 122*b* to communicatively couple the press line PLC 106 and the manufacturing die 130.

The plurality of signal pathways 300 may comprise die signal pathways 310, direct signal pathways 330, and duplicate signal pathways 350. The die signal pathways 310 may extend between the die cable end 221 of the die cable 220 and an electronics terminal 250 positioned within the housing 210 of the die compatibility adaptor 200. The direct signal pathways 330 may extend between the direct cable receptacle 222 and the electronics terminal 250. The duplicate signal pathways 350 may extend between the duplicate cable receptacle 224 and the electronics terminal 250. Further, the electronics terminal 250 may comprise a plurality of terminal connectors 252*a*-252*f*, which each comprise an electrical coupling location for individual signal pathways of the plurality of signal pathways 300. For example, each terminal connector 252*a*-252*f* may couple an individual die signal pathway 310 with an individual direct signal pathway 330 and/or an individual duplicate signal pathway 350.

The die signal pathways 310 may be communicatively coupled to the direct signal pathways 330 and/or the duplicate signal pathways 350, for example, to communicatively couple the die cable end 221 with the direct cable receptacle 222 and/or the duplicate cable receptacle 224. Individual die signal pathways 310 may include a die power signal pathway 312 that extends between the die cable end 221 and a first terminal connector 252*a* and may be configured to carry a power signal between the die cable end 221 and the first terminal connector 252*a*. A die neutral signal pathway 314 extends between the die cable end 221 and a second terminal connector 252*b* and comprises an electronic pathway section configured to carry a neutral signal between the die cable end 221 and the second terminal connector 252*b*.

In some embodiments, the die signal pathways 310 further include a first die proximity signal pathway 316 that extends between the die cable end 221 and a third terminal connector 252*c* and may be configured to carry a proximity signal output by the first proximity sensor 136*a* between the die cable end 221 and the third terminal connector 252*c*. A second die proximity signal pathway 318 extends between the die cable end 221 and a fourth terminal connector 252*d* and may be configured to carry a proximity signal output by the second proximity sensor 136*b* between the die cable end 221 and the fourth terminal connector 252*d*. Further, the first and second die interlock pathways 320, 322 extend between the die cable end 221 and fifth and sixth terminal connectors 252*e*, 252*f*, respectively, and each comprise section of electronic pathways configured to carry interlock signals output by the gas sensor 160 between the die cable end 221 and fifth and sixth terminal connectors 252*e*, 252*f*. It should be understood that any additional die signal pathways 310 are contemplated to carry a signal between the die cable end 221 and the electronics terminal 250.

The direct signal pathways 330 may be communicatively coupled to the die signal pathways 310, for example, at the electronics terminal 250, to form electronic pathways that extend between the die cable end 221 and the direct cable receptacle 222. For example, a direct power signal pathway 332 extends between the direct cable receptacle 222 and the first terminal connector 252*a* and is communicatively coupled to the die power signal pathway 312 at the first terminal connector 252*a* to form an electronic pathway configured to carry a power signal between the direct cable receptacle 222 and the die cable end 221, for example, a power signal output by the press line PLC 106, machine press 110, or the like. In some embodiments, this power signal may provide power to the first and second proximity sensors 136*a*, 136*b* and the gas sensor 160. Further, a direct neutral signal pathway 334 extends between the direct cable receptacle 222 and the second terminal connector 252*b* and is communicatively coupled to the die neutral signal pathway 314 at the second terminal connector 252*b* to form an electronic pathway configured to carry a neutral signal between the die cable end 221 and the direct cable receptacle 222, for example, to form a circuit with the power signal pathway formed by the die power signal pathway 312 and the direct power signal pathway 332.

As depicted in FIG. 3, a first direct proximity signal pathway 336 extends between the direct cable receptacle 222 and the third terminal connector 252*c* and is communicatively coupled to the first die proximity signal pathway 316 at the third terminal connector 252*c* to form an electronic pathway configured to carry a first proximity signal output by the first proximity sensor 136*a* between the die cable end 221 and the direct cable receptacle 222. In operation, the first proximity signal communicates the presence or absence of the first workpiece 142*a* within the first workspace 140*a*. Further, the first proximity signal is receivable by the first bolster cable 122*a* when the first bolster cable 122*a* is coupled to the direct cable receptacle 222.

Further, a second direct proximity signal pathway 338 extends between the direct cable receptacle 222 and the fourth terminal connector 252*d* and is communicatively coupled to the second die proximity signal pathway 318 at the fourth terminal connector 252*d* to form an electronic pathway configured to carry a second proximity signal output by the second proximity sensor 136*b* between the die cable end 221 and the direct cable receptacle 222. In operation, the second proximity signal communicates the presence or absence of the second workpiece 142*b* within the second workspace 140*b*. Further, the second proximity signal is receivable by the first bolster cable 122*a* when the first bolster cable 122*a* is coupled to the direct cable receptacle 222.

Further, first and second direct interlock signal pathways 340, 342 extend between the direct cable receptacle 222 and the fifth and sixth terminal connectors 252*e*, 252*f*, respectively, and are communicatively coupled to the first and second die interlock signal pathways 320, 322 at the fifth and sixth terminal connectors 252*e*, 252*f*, respectively, to form an electronic pathway configured to carry interlock signals output by the gas sensor 160 between the die cable end 221 and the direct cable receptacle 222. In operation, the interlock signals may communicate an issue with the one or more gas springs 162 and are receivable by the first bolster cable 122*a* when the first bolster cable 122*a* is coupled to the direct cable receptacle 222. It should be understood that any additional direct signal pathways 330 are contemplated to carry a signal between the direct cable receptacle 222 and the electronics terminal 250.

As depicted in FIG. 3, the duplicate signal pathways 350 may comprise a duplicate power signal pathway 352, a duplicate neutral signal pathway 354, a first duplicate proximity signal pathway 356, and a second duplicate proximity signal pathway 358. In some embodiments, the duplicate power signal pathway 352 extends between the duplicate cable receptacle 224 and one or both of the first isolation relay 240*a* and the second isolation relay 240*b*. The duplicate power signal pathway 352 is configured to carry a power signal between the duplicate cable receptacle 224 and one or both of the first isolation relay 240*a* and the second isolation relay 240*b*, for example, when the second bolster cable 122*b* is engaged with the duplicate cable receptacle 224. In some embodiments, the first and second isolation relays 240*a*, 240*b* are electrically connected such that providing a power signal to one of the first or second isolation relays 240*a*, 240*b* also provides a power signal to the other. Further, the duplicate neutral signal pathway 354 extends between the duplicate cable receptacle 224 and the first isolation relay 240*a* and/or the second isolation relay 240*b* and is configured to carry a neutral signal between the duplicate cable receptacle 224 and the first isolation relay 240*a* and/or the second isolation relay 240*b*, for example, to form a circuit with the duplicate power signal pathway 352.

The first duplicate proximity signal pathway 356 extends between the duplicate cable receptacle 224 and the third terminal connector 252*c* and is communicatively coupled to the first die proximity signal pathway 316 at the third terminal connector 252*c* to form an electronic pathway configured to carry the first proximity signal output by the first proximity sensor 136*a* between the die cable end 221 and the duplicate cable receptacle 224. Further, the first duplicate proximity signal pathway 356 may extend through the first isolation relay 240*a*. In operation, the first proximity signal communicates the presence or absence of the first workpiece 142*a* within the first workspace 140*a* and is receivable by the second bolster cable 122*b* when the second bolster cable 122*b* is coupled to the duplicate cable receptacle 224. Further, when both the first and second bolster cables 122*a*, 122*b* are coupled to the direct and duplicate cable receptacles 222, 224 and the die cable end 221 is coupled to the manufacturing die 130, the first proximity signal is split, for example, at the third terminal connector 252*c*, such that the first and second bolster cables 122*a*, 122*b* receive a portion of the first proximity signal output by the first proximity sensor 136*a*.

Further, the second duplicate proximity signal pathway 358 extends between the duplicate cable receptacle 224 and the fourth terminal connector 252*d* and is communicatively coupled to the second die proximity signal pathway 318 at the fourth terminal connector 252*d* to form an electronic pathway configured to carry the second proximity signal output by the second proximity sensor 136*b* between the die cable end 221 and the duplicate cable receptacle 224. Further, the second duplicate proximity signal pathway 358 may extend through the second isolation relay 240*b*. In operation, the second proximity signal may communicate the presence or absence of the second workpiece 142*b* within the second workspace 140*b* and is receivable by the second bolster cable 122*b* when the second bolster cable 122*b* is coupled to the duplicate cable receptacle 224. Further, when both the first and second bolster cables 122*a*, 122*b* are coupled to the direct and duplicate cable receptacles 222, 224 and the die cable end 221 is coupled to the manufacturing die 130, the second proximity signal is split, for example, at the fourth terminal connector 252*d*, such that both the first and second bolster cables 122*a*, 122*b* receive a portion of the second proximity signal output by the second proximity sensor 136*b*.

In operation, when the second bolster cable 122*b* is engaged with the duplicate cable receptacle 224, power is provided to the first and second isolation relays 240*a*, 240*b* along the duplicate power signal pathway 352 and the first and second isolation relays 240*a*, 240*b* are actuated into the closed position 241*a*, 241*b*. Further, when the second bolster cable 122*b* is removed from the duplicate cable receptacle 224, power is removed from the first and second isolation relays 240*a*, 240*b*, which actuates the first and second isolation relays 240*a*, 240*b* into the open position 242*a*, 242*b*. By actuating both the first and second isolation relays 240*a*, 240*b* into the open position 242*a*, 242*b* when the second bolster cable 122*b* is removed, stray or unwanted signals may not reach the duplicate cable receptacle 224, which can reduce the occurrence of unintended power availability at the duplicate cable receptacle 224.

It should now be understood that the above described press line systems include a die compatibility adaptor for communicatively coupling a manufacturing die with a machine press having first and second bolster cables each communicatively coupled to a press line PLC. The manufacturing die includes a first proximity sensor configured to output a first proximity signal and a second proximity sensor configured to output a second proximity signal. The die compatibility adaptor is configured to split both the first and second proximity signals output by the first and second proximity sensors, such that a first portion of both the first and second proximity signals are receivable by the first bolster cable and a second portion of both the first and second proximity signals are receivable by the second bolster cable. By splitting the first and second proximity signals, the die compatibility adaptor facilitates communicative coupling between a two proximity channel manufacturing die, configured to output two individual proximity signals, and a four proximity channel press line PLC, configured to receive two pairs of proximity signals.

It is noted that the term "substantially" may be utilized herein to represent the inherent degree of uncertainty that may be attributed to any quantitative comparison, value, measurement, or other representation. This term is also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A machine press system comprising:

a machine press comprising a first bolster cable and a second bolster cable;

a manufacturing die coupled to the machine press, the manufacturing die comprising a first proximity sensor configured to sense the presence and absence of a first workpiece within a first workspace and a second proximity sensor configured to sense the presence and absence of a second workpiece within a second workspace; and a die compatibility adaptor comprising:

a housing;

a die cable extending outward from the housing and terminating at a die cable end engageable with the manufacturing die;

a direct cable receptacle communicatively coupled to the die cable and configured to receive the first bolster cable;

a duplicate cable receptacle configured to receive the second bolster cable; and one or more isolation relays positioned between and communicatively coupled to the duplicate cable receptacle and the die cable, the one or more isolation relays comprising a closed position and an open position, wherein in the closed position the duplicate cable receptacle is communicatively coupled to the die cable.

2. The machine press system of claim 1, wherein the first bolster cable and the second bolster cable are communicatively coupled to a press line programmable logic controller.

3. The machine press system of claim 1, wherein the one or more isolation relays are actuated into the closed position when the second bolster cable is engaged with the duplicate cable receptacle.

4. The machine press system of claim 1, wherein the manufacturing die further comprises a die communications module communicatively coupled to the first proximity sensor and the second proximity sensor and wherein the die cable is engageable with the die communications module.

5. The machine press system of claim 1, wherein the first proximity sensor is positioned within the first workspace of the manufacturing die and the second proximity sensor is positioned within the second workspace of the manufacturing die.

6. The machine press system of claim 5, wherein the first proximity sensor outputs a first proximity signal when the first workpiece is positioned within the first workspace and the second proximity sensor outputs a second proximity signal when the second workpiece is positioned within the second workspace.

7. The machine press system of claim 1, wherein the one or more isolation relays each comprise a solid state relay.

8. A method of communicatively coupling a manufacturing die and a machine press, the method comprising:

positioning a manufacturing die on a machine press, wherein the machine press comprises a first bolster cable and a second bolster cable and the manufacturing die comprises a first proximity sensor configured to sense the presence and absence of a first workpiece within a first workspace and a second proximity sensor configured to sense the presence and absence of a second workpiece within a second workspace;

providing a die compatibility adaptor comprising:

a housing;

a die cable engageable with the manufacturing die;

a direct cable receptacle communicatively coupled to the die cable and configured to receive the first bolster cable;

a duplicate cable receptacle configured to receive the second bolster cable; and one or more isolation relays positioned between and communicatively coupled to the duplicate cable receptacle and the die cable, the one or more isolation relays comprising a closed position and an open position, wherein in the closed position the duplicate cable receptacle is communicatively coupled to the die cable;

coupling the die cable to the manufacturing die;

coupling the first bolster cable to the direct cable receptacle; and coupling the second bolster cable to the duplicate cable receptacle.

9. The method of claim 8, wherein coupling the die cable to the manufacturing die and coupling the first bolster cable to the direct cable receptacle communicatively couples the first proximity sensor and the second proximity sensor of the manufacturing die with the first bolster cable.

10. The method of claim 8, wherein coupling the second bolster cable and the duplicate cable receptacle actuates the one or more isolation relays into the closed position such that the first proximity sensor and the second proximity sensor of the manufacturing die are communicatively coupled with the second bolster cable.

11. The method of claim 8, wherein the first proximity sensor is configured to output a first proximity signal when the first workpiece is positioned within the first workspace of the manufacturing die and the second proximity sensor is configured to output a second proximity signal when the second workpiece is positioned within the second workspace of the manufacturing die.

12. The method of claim 11, wherein the die compatibility adaptor is configured to split the first proximity signal and the second proximity signal such that the direct cable receptacle and the duplicate cable receptacle each receive portions of the first proximity signal and the second proximity signal.

* * * * *